US005556329A

United States Patent [19]

VonSick

[11] Patent Number: 5,556,329

[45] Date of Patent: Sep. 17, 1996

[54] CHIMNEY DAMPER WITH LOCKING MECHANISM

[75] Inventor: Hal A. VonSick, Louisville, Ky.

[73] Assignee: Fireplace Technologies, Inc., Louisville, Ky.

[21] Appl. No.: 393,345

[22] Filed: Feb. 23, 1995

[51] Int. Cl.[6] ..... F23L 17/10

[52] U.S. Cl. ..... 454/4; 251/89

[58] Field of Search ..... 454/4, 7, 20, 26, 454/28, 357, 369; 137/72, 74; 251/89

[56] References Cited

U.S. PATENT DOCUMENTS

| | | | |
|---|---|---|---|
| 2,242,738 | 5/1941 | Alton | 454/357 X |
| 2,313,350 | 3/1943 | Lebus . | |
| 4,020,754 | 5/1977 | Dalsin et al. | 454/4 |
| 4,481,933 | 11/1984 | Sawtelle . | |
| 5,125,869 | 6/1992 | VonSick | 454/4 |
| 5,163,516 | 11/1992 | Palmatier | 165/54 |
| 5,193,622 | 3/1993 | Tibbling | 165/54 |
| 5,247,998 | 9/1993 | Fallon | 169/49 |

*Primary Examiner*—Harold Joyce
*Attorney, Agent, or Firm*—Wheat, Camoriano, Smith & Beres, PLC

[57] ABSTRACT

A chimney damper is provided with a locking mechanism which prevents the chimney damper from closing in the event of a chimney fire.

7 Claims, 3 Drawing Sheets

CHIMNEY DAMPER WITH LOCKING MECHANISM

BACKGROUND INVENTION

The present invention relates to a chimney damper, and more particularly, to a chimney damper which includes a locking mechanism which prevents the chimney damper from closing in the event of a chimney fire.

The prior art shows various chimney dampers for closing a chimney or flue when it is not in use. A prior patent which generally describes the chimney damper but without the current improvement is U.S. Pat. No. 5,125,869, which is hereby incorporated by reference. Most of the prior art chimney dampers include a cap and a biasing means to separate the cap from the chimney flue when the damper is open. In the event of a chimney fire, the extreme heat may cause the biasing means to fail. If the biasing means fails, the cap may partially or completely close. Some of the smoke emitted from the chimney fire may then be directed back down the chimney and into the building, causing smoke damage.

SUMMARY OF THE INVENTION

The present invention provides a chimney damper with a locking mechanism to ensure that the chimney cap remains open in the event of a chimney fire. The locking mechanism of the present invention is very simple and reliable, not requiring the use of numerous parts which might fail in a fire.

DESCRIPTION OF THE PREFERRED EMBODIMENT

Figure 1:
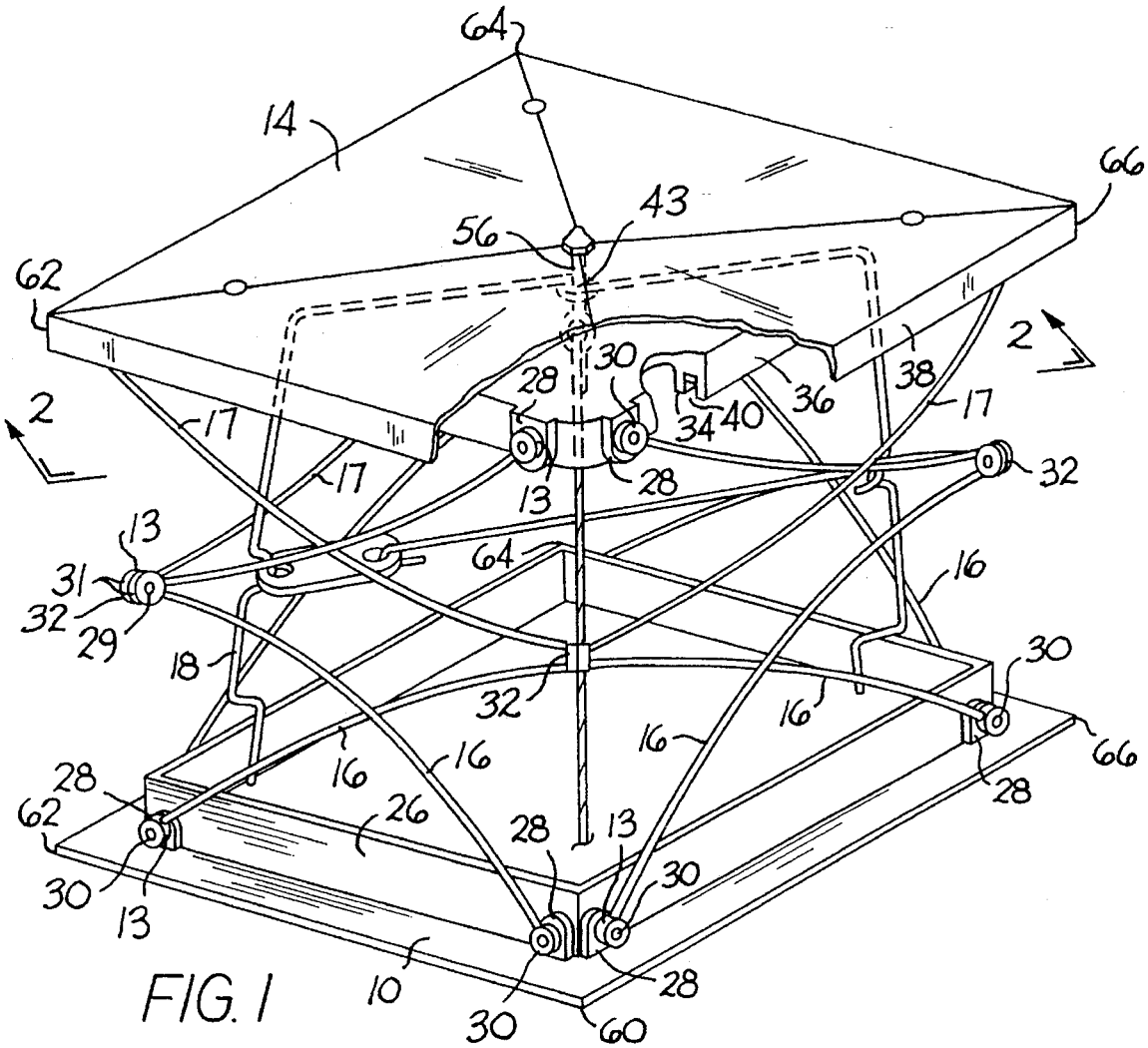
FIG. 1 is a perspective view, partially broken-away, of a preferred embodiment of a chimney damper made in accordance with the present invention.

Referring to FIGS. 1–5, the chimney damper 8 includes a frame 10 which is intended to be mounted on the top of a chimney flue 12. The chimney damper 8 also includes a cap 14 to cover the opening defined by the frame 10. A plurality of spring wires 16, 17 biases the cap 14 in an open position, separated from the frame 10, and a locking mechanism 18 prevents the cap 14 from closing in the event of a chimney fire.

The frame 10 of the damper 8 is provided with a rectangular upstanding frame flange 26 along its inner edge. The exterior sides of the frame flange 26 include bosses 28 located at opposite ends of each portion of the flange 26. Each of the lower spring wires 16 is pivotably connected at its lower end to one of the bosses 28 by a screw 30 which extends through a loop 13 in the end of the spring wire 16. Each of the upper spring wires 17 is pivotably attached at its upper end to a boss 28 on the outer cap flange 36 of the cap 14 by means of a screw 30, which extends through a loop 13 in the end of the respective spring wire 17. The upper end of each of the lower spring wires 16 is attached to the upper end of the lower spring wire 16 from the opposite corner and to the lower ends of two respective upper spring wires 17 from the corresponding corners of the cap 14 by means of a fastener 32, which extends through loops 13 in the ends of the respective spring wires 16, 17. Each fastener 32 includes washers 31 and a rivet 29. The loops 13 in the spring wires 16, 17 are placed between the washers 31, and the rivet 29 is projected through the loops 13 and the washers 31 so that they are held together and cannot pivot.

There are four fasteners 32 in this biasing mechanism. Each fastener 32 is positioned above one of the corners of the rectangular frame. Each of the fasteners receives two lower spring wires 16 and two upper spring wires 17 that originate from opposite corners. As shown in FIG. 1, the four corners of the chimney damper 8 are designated as 60, 62, 64, and 66. The fastener 32 at the corner 60 receives lower and upper spring wires 16, 17, respectively, which are attached to the opposite corners 62 and 66 of the frame 10 and cap 14, respectively. The fastener 32 at the corner 62 receives lower and upper spring wires 16, 17, respectively, which are attached to the opposite corners 60 and 64 of the frame 10 and cap 14, respectively. The fastener 32 at the corner 64 receives lower and upper spring wires 16, 17, respectively, which are attached to the opposite corners 62 and 66 of the frame 10 and cap 14, respectively. The fastener 32 at the corner 66 receives lower and upper spring wires 16, 17, respectively, which are attached to the opposite corners 60 and 64 of the frame 10 and cap 14, respectively. The upper and lower spring wires 16, 17, connected to the cap 14 and frame 10 and to each other, form a biasing mechanism which biases the cap 14 in an open position, separated from the frame 10. 0f course, other biasing mechanisms are also known in the art and could be used in the present invention.

The cap 14 is formed with two downwardly-oriented inner and outer cap flanges 34, 36, respectively, in close parallel alignment. This arrangement provides a narrow channel 40 between the inner and outer cap flanges 34, 36 to receive the upstanding frame flange 26 when the damper 8 is closed. A tight seal results between the cap 14 and frame 10 when the damper is closed to prevent escape or entry of air or blowing rain. The cap 14 extends horizontally beyond the outer cap flange 36 and also includes a downwardly-oriented perimeter flange 38 along its outer perimeter. The position of this perimeter flange 38 is such that, when the damper is closed, the perimeter flange 38 and outer cap flange 36 enclose the lower and upper spring wires 16, 17 to protect them from damaging temperatures.

Figure 2:
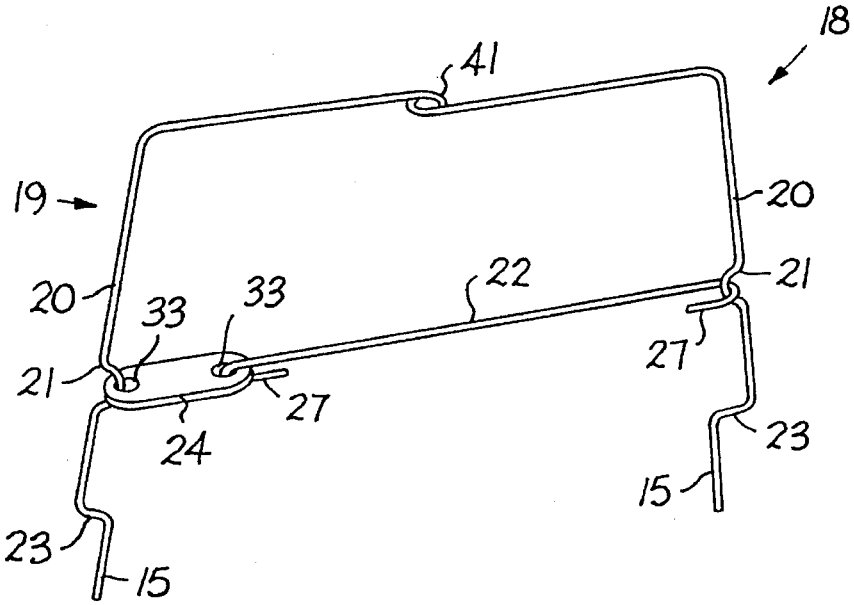
FIG. 2 is a view taken along section 2—2 of FIG. 1 but showing only the locking mechanism portion of the chimney damper.

The locking mechanism 18, shown in all the figures but shown alone in FIG. 2, includes a wire form 19, a fusible link 24, and a connecting arm 22. The wire form 19 is preferably made from a thick, resilient wire and is generally in the shape of an inverted-U, having two downwardly-extending, resilient leg portions 20. There is a loop 41 formed in the top center of the inverted "U", which permits the locking mechanism to be connected to the damper 8 by means of a bolt 56, which bolts through a hole 43 in the center of the cap 14 and through the loop 41 in the wire form. The locking mechanism lies inside the spring wires 16, 17 and does not interfere with the opening and closing of the cap 14 under normal operating conditions. In the preferred embodiment, the locking mechanism 18 is mounted so that it is aligned with opposite corners 62, 66 of the cap 14.

Each of the leg portions 20 of the locking mechanism 18 is formed with a slight inward indentation 21 near its midpoint. Below the indentation 21, each leg 20 has a projection extending inwardly to define a ledge 23. The remaining extension 15 of each leg 20 is oriented downwardly. Each extension 15 extends below the top of the frame flange 26 even when the damper 8 is open.

In the normal operating position (FIGS. 1–4), the flexible legs 20 are flexed toward each other by the connecting arm 22 and the fusible link 24. The connecting arm 22 is made with hooks 27 on both ends, and the fusible link is made with holes 33 in both ends. The hook 27 on one end of the connecting arm 22 extends around one of the leg portions 20 and rests in the indentation 21 of that leg portion 20. The hook 27 on the other end of the connecting arm 22 is hooked through one of the holes 33 in the fusible link 24. The other leg portion 20 extends through the other hole 33 of the fusible link 24, with the fusible link 24 resting in the indentation 21 of that leg 20. The tension in the connecting arm 22 and the fusible link 24 pulls the legs 20 inwardly and keeps the connecting arm hook 27 in the indentation 21 of one leg 20 and the hole 33 of the fusible link 24 in the indentation 21 of the other leg 20, thereby preventing the connecting arm 22 or fusible link 24 from sliding up or down the leg portions 20.

Fusible links are commonly used in the fire protection industry for purposes other than the present invention, such as to cause doors to automatically close in the event of a fire. They are designed to fail at a specified temperature. As long as the fusible link 24 in the present device remains intact, the leg portions 20 remain in their normal, retracted position, in which they do not interfere with the opening and closing of the damper. When the fusible link 24 fails, the resilient leg portions 20 move to an extended, locking position which prevents the damper from closing.

Figure 3:
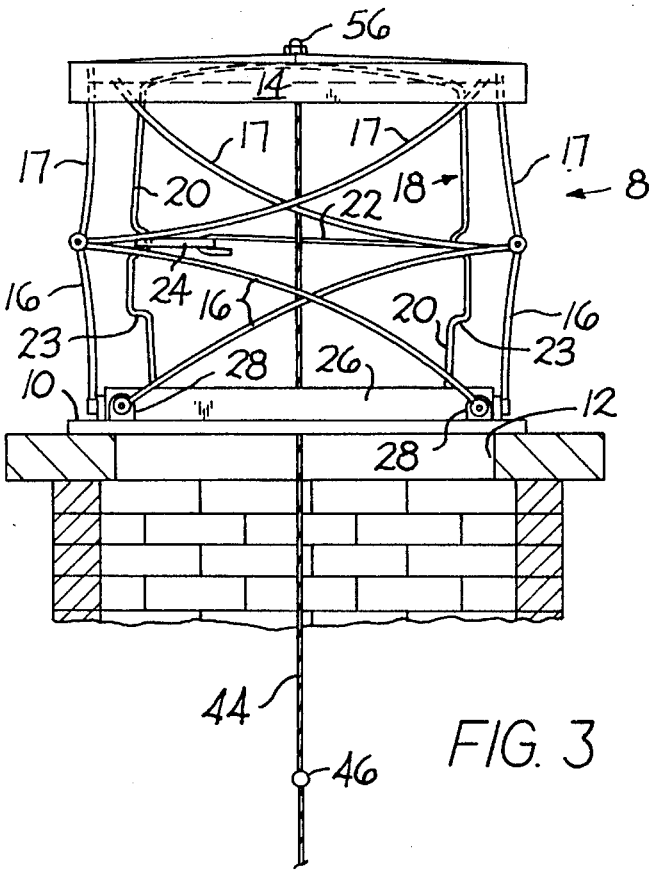
FIG. 3 is a front view of the chimney damper of FIG. 1 mounted on a chimney, with the chimney shown in section, with the locking mechanism in the normal operating position and the damper in the open position.
Figure 4:
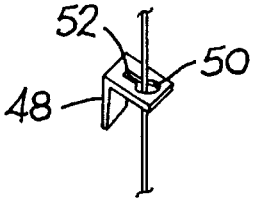
FIG. 4 is the same view as FIG. 3, but with the damper in the closed position.
Figure 4:
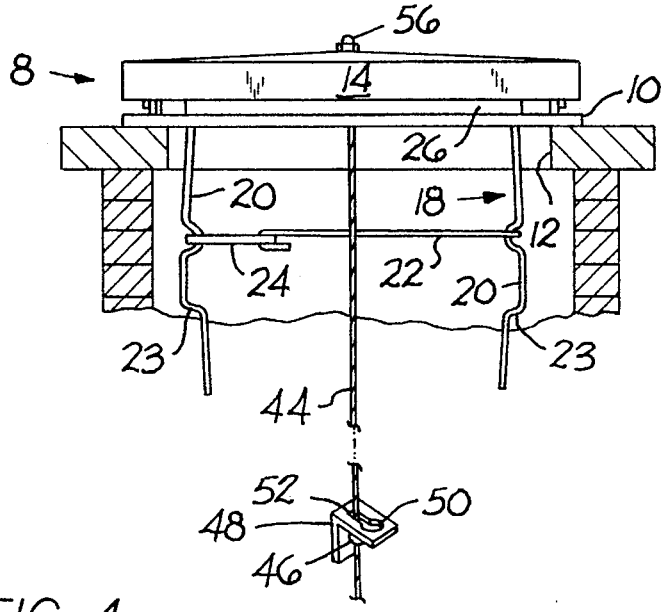

FIGS. 3 and 4 show the chimney damper with the locking mechanism 18 in a normal operating position (retracted). In FIG. 3, the damper is open, and in FIG. 4, the damper is closed. When the locking mechanism 18 is in this normal position, the legs 20 are flexed inwardly by the tension of the fusible link 24 and the connecting arm 22 so that the ledges 23 on the locking mechanism 18 do not contact the flange 26 on the frame 10 as the chimney cap 14 is lowered.

A control cable 44 is provided to manually open and close the chimney cap 14. One end of the cable 44 is connected to the threaded eye-bolt 56, which is attached to the center of the cap 14, and the other end of the control cable 44 extends through the opening 50 of a horizontally-oriented bracket 48, which is intended to be mounted on the interior of the chimney. There is a narrow slot 52 on one side of the main opening 50 of the bracket 48, which is used to close the cap 14. The control cable 44 is formed with an enlarged section 46, such as a knot or ball, as shown in FIG. 3. The chimney cap 14 is closed, as in FIG. 4, by pulling down on the control cable 44 until the enlarged section 46 passes through the opening 50 of the bracket 48 and then pulling the control cable 44 into the narrow slot 52 so that the upper side of the enlarged section 46 engages the underside of the bracket 48 at the slot 52, holding the damper closed against the biasing force of the spring wires 16, 17. The cap 14 is retained in the closed or down position until the enlarged section 46 is moved back into alignment with the main opening 50, where it can pass through, as the force of the spring wires 16, 17 causes the damper 8 to open.

Figure 5:
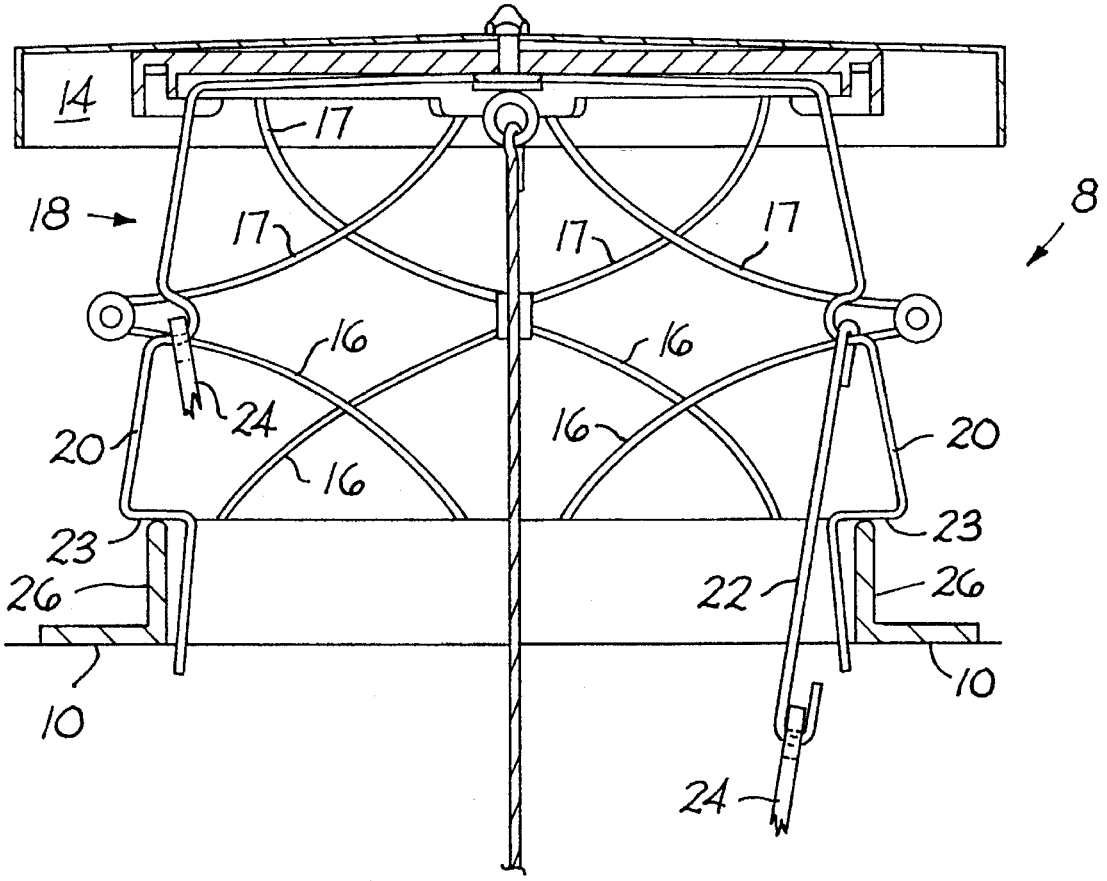
FIG. 5 is a view along section 2—2 of FIG. 1, but with the locking mechanism in the extended, locking position, to prevent the closing of the damper.

FIG. 5 shows the chimney damper 8 with the locking mechanism 18 in the locked position, which prevents the closing of the damper. The locking mechanism 18 moves to this position when the fusible link 24 breaks due to the extreme heat from a chimney fire. The fusible link 24 of the embodiment shown here is preferably designed to break at a temperature above 621° F. When the fusible link 24 breaks, it releases the connecting arm 22 and allows the legs 20 to spring to their extended (locking) position. In this extended, locking position, the ledges 23 lie above the flange 26 on the frame 10 rather than inside the flange 26 as they did in the normal, retracted position. If there is any attempt to close the damper, the ledges 23 will interfere with the frame flange 26 to prevent the damper from closing. Even if the springs 16, 17 fail due to the extreme heat from the chimney fire, the cap 14 cannot close because of the interference between the ledges 23 of the locking mechanism 18 and the frame flange 26.

It will be understood that the foregoing is but one example of an arrangement within the scope of the present invention and that modifications and other arrangements also within the scope of the present invention will be obvious to those skilled in the art upon reading the disclosure set forth above.

What is claimed is:

1. A chimney damper, comprising:

a frame, adapted to be located on the top of a chimney;

a cap for closing off the top of the chimney;

at least one spring which biases said cap to a position separated from said frame; and a locking mechanism, including at least one resilient leg interposed between said cap and said frame; a fusible link which holds said resilient leg in a retracted position, such that, if said fusible link breaks, it releases said resilient leg so that said resilient leg moves to an extended position, in which it interferes with at least one of said cap and frame, thereby preventing said damper from being closed.

2. A chimney damper as recited in claim 1, wherein said locking mechanism includes at least two of said resilient legs interposed between said cap and said frame, said legs normally being held in a retracted position by said fusible link and moving to an extended, locking position when said fusible link breaks.

3. A chimney damper as recited in claim 2, wherein each of said resilient legs defines a ledge, and said frame includes an upstanding flange, said ledge and said flange interfering with each other and prohibiting the closing of the damper when said fusible link is broken and said legs are in the extended position.

4. A chimney damper as recited in claim 2, wherein said locking mechanism further includes a connecting arm which is connected to said fusible link and to one of said legs, so that two of said legs are tied together and held in a retracted position by said fusible link and said connecting arm.

5. A chimney damper as recited in claim 4, wherein each of the legs defines at least one indentation; with the connecting arm being connected to one of the two legs at its respective indentation and the fusible link being connected to the other of the two legs at its respective indentation to prevent the connecting arm and fusible link from sliding relative to the legs.

6. A chimney damper as recited in claim 3, wherein said upstanding flange defines a rectangle with four corners, said interference between said ledge and said flange occurring in opposite corners of said flange.

7. A chimney damper, comprising:

a frame;

a cap;

a spring for biasing the cap to an open position, separated from the frame; and a locking mechanism for locking the damper in the open position in the event of a chimney fire, wherein said locking mechanism includes a fusible link which is adapted to fail at a high temperature.

* * * * *